United States Patent [19]

Schmidgall

[11] 3,993,190

[45] Nov. 23, 1976

[54] APPARATUS FOR PACKAGING AND DISPENSING A STAIN REMOVING AGENT IN PORTIONS

[75] Inventor: Heinz Schmidgall, Teufen, Switzerland

[73] Assignee: Chemiro AG, Saint Gall, Switzerland

[22] Filed: June 19, 1975

[21] Appl. No.: 588,145

[30] Foreign Application Priority Data

June 24, 1974 Germany ..... 2430146

[52] U.S. Cl. ..... 206/229; 206/484; 206/531; 229/11; 401/132

[51] Int. Cl.[2] ..... B65D 69/00; B43K 5/14

[58] Field of Search.... 206/466, 461, 528, 238–241, 206/484, 537, 223, 229; 215/32; 229/9–11, 19, 20, 51 CE; 30/93, 1 J; 401/132

[56] References Cited

UNITED STATES PATENTS

| | | | |
|---|---|---|---|
| 587,327 | 8/1897 | Planten | 206/528 |
| 1,826,809 | 10/1931 | Metz | 206/530 |
| 3,741,387 | 6/1973 | Whitecar | 206/461 X |
| 3,900,104 | 8/1975 | Harned | 229/9 X |
| 3,905,478 | 9/1975 | Gerner et al. | 206/461 X |

*Primary Examiner*—Leon Gilen

*Attorney, Agent, or Firm*—Price, Heneveld, Huizenga & Cooper

[57] ABSTRACT

The specification discloses a method and apparatus for packaging and dispensing stain removing agents in small, individualized capsules. The stain removing agents are preferably in paste form. The individual capsules are readily deformable and are stored in individual troughs in a receiving plate which, in turn, is covered by a covering sheet.

14 Claims, 4 Drawing Figures

APPARATUS FOR PACKAGING AND DISPENSING A STAIN REMOVING AGENT IN PORTIONS

BACKGROUND OF THE INVENTION

The invention relates to a method and apparatus, i.e., a packaging system, for receiving in portions a stain removing agent preferably in paste form.

Stain removing agents in paste form are becoming more readily accepted than liquid stain removing agents because they make possible a removal of stains without any margins. Collapsible tubes are filled with the stain removing agents in paste form and the latter are taken from the tubes in portions as required. In this respect, great care must be taken to see that after each removal of agent the collapsible tube is closed again in a sealing manner, as otherwise the liquid solvent comprised in the stain removing agent evaporates so that the paste dries out. Stain removing agents in paste form kept in collapsible tubes dry out even if this rule is strictly adhered to, because on rolling up the tube which has been emptied portion-by-portion, it is impossible to avoid the formation of hair cracks in the tube wall and the solvent evaporates through these cracks.

One possibility for removing a stain removing agent in paste form portion-by-portion from a storage container without the danger of evaporation of the solvent is that of storing the stain removing agent in a paste form in an aerosol bottle or container. Aerosol containers are, however, not always popular because the propellant utilized in them develops substantial pressures. Raised temperatures must be avoided at all costs and instruction for use, for example, as regards keeping to a precise distance between the aerosol container and the article of clothing to be cleaned on spraying, must be adhered to.

The problem of removing a stain removing agent in liquid form in portions appears to have been already solved. A previous proposal has been made to fill liquid stain removing agents in portions into glass ampoules, which are surrounded by a plastic casing which at one end has a wick. The glass ampoule inside the plastic casing is crushed so that the contents can be taken up by the wick and from the wick can be applied to the stain to be removed. However, it is not in all cases possible to ensure that the plastic casing is completely reliable and in fact there is the danger that small splinters of glass may escape and lead to injury.

SUMMARY OF THE INVENTION

The object of the present invention is that of providing an apparatus or packaging system for receiving in portions a stain removing agent preferably in paste form, to avoid the disadvantages of the previously proposed packages for paste form stain removing agents. Also the defects of the previously proposed portion package for liquid stain removing agents are avoided.

The invention achieves this object by means of the stain removing agent being enclosed in capsules which can be deformed by the action of pressure and which are placed preferably individually in receiving troughs in a receiving plate. The capsules are covered by a covering foil extending over the receiving plate.

Preferably the capsules are shaped like bottles and are made of a plastic material which can be readily deformed. At the bottle neck it is preferred to provide a zone of weakness which makes it possible either to twist off the bottle neck or to easily remove it in some other manner.

It is also advantageous to provide saw teeth or another form of cutting edge at least on one edge of the receiving plate. With this means it is possible to remove the bottle neck so that the stain removing agent in paste form can be squeezed out of the capsule.

Other preferred features of the invention include the receiving plate having a corrugated shape at one edge and, thus, provide a sort of brush with which the dried stain removing agent can be brushed off from the material to be cleaned; the receiving plate including at least one folding flap for advertising text and/or instructions for use; and the box including a suspension rail or flap for hanging it up.

BRIEF DESCRIPTION OF THE DRAWINGS

The invention will now be described with reference to one embodiment shown in the drawings.

DESCRIPTION OF THE PREFERRED EMBODIMENT

Figure 1:
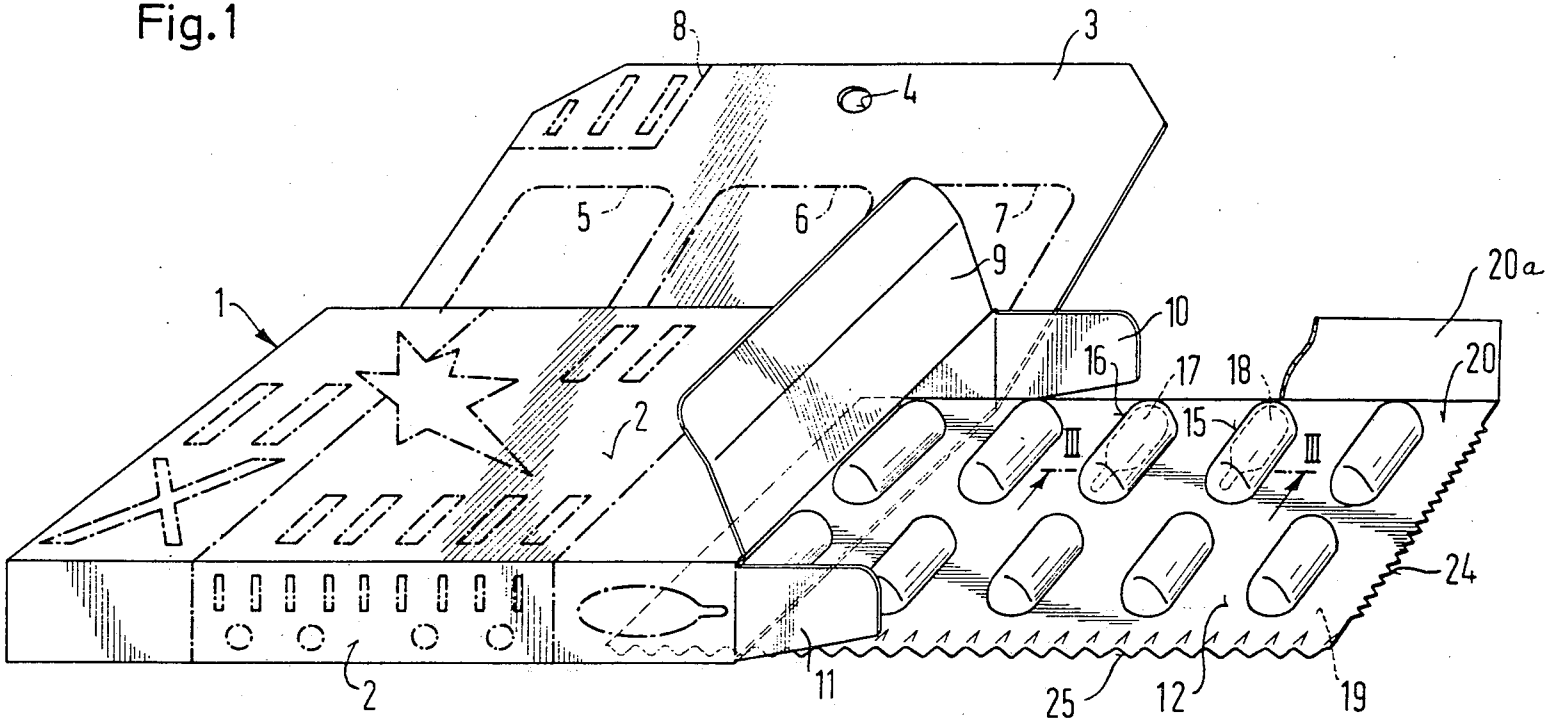
FIG. 1 shows a perspective view of a box comprising the apparatus in accordance with the invention.

In FIG. 1 reference numeral 1 denotes a conventional folding box which has lettering, advertising text, advertising figures and the like as is denoted at reference numeral 2 for example. The box is provided with a suspending rail or tag 3 with a hole 4 with whose help the box can be suspended on a projecting pin along with other such boxes. The suspending tag is provided for example with a series of FIGS. 5, 6, 7 as instructions for use for employing the apparatus in accordance with the invention and may also be provided if necessary with further lettering or text as is denoted by reference numeral 8. On the right-hand side, in the case of the embodiment shown, the box is opened. The folding flap 9 and the two side flaps 10 and 11, respectively, are opened.

Figure 2:
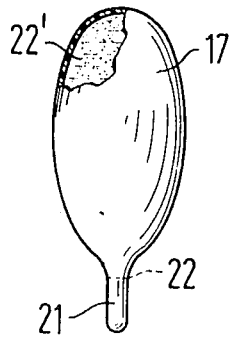
FIG. 2 shows a capsule comprising the stain removing agent in paste form.
Figure 3:
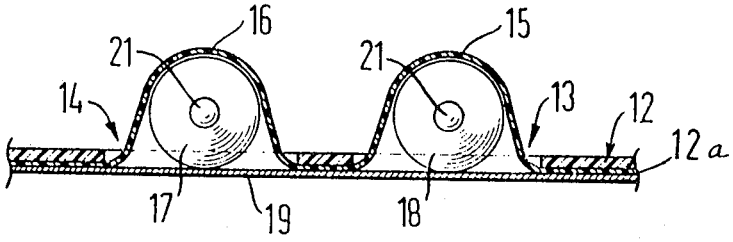
FIG. 3 shows the receiving plate with its troughs and the covering foil.

A receiving or carrying plate 12 is drawn out of the box, a section of this plate being shown in detail in FIG. 3. It has openings, as indicated at 13 and 14 in FIG. 3, through which troughs 15 and 16 formed in a sheet of plastic material **12*a* extend. In these troughs 15 and 16, capsules 17 and 18 are contained or received. These capsules are just large enough to hold sufficient stain removing agent to clean a typical individual stain. For unusually large stains two or more capsules might be used. One capsule is shown in detail in plan view in FIG. 2, and it will be described in more detail below. The troughs are covered by a further foil 19. By pressing on the upper side of the troughs 15 and 16, respectively, it is possible to press the capsules 17 and 18 out through the foil 19. On one edge 20 of receiving plate 12, folding flaps 20*a*** are provided on which advertising text and/or instructions for use can be printed.

Figure 4:
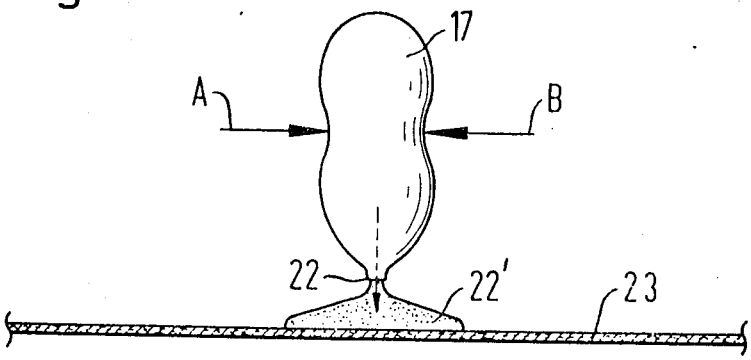
FIG. 4 shows the capsule with the neck broken off, on which pressure has been exerted from the side in order to apply the contents of the capsule to a piece of textile material, for example.

The capsule 17, shown in FIG. 2 is made of gelatine or other plastic material and has a neck 21, which is separated from the body of the capsule 17, preferably, by a zone of weakness 22. Preferably, zone 22 is treated by drawing the neck during formation of the capsule, providing a slightly narrower and thinner walled zone 22. This is done during the capsule sealing process, after the capsules have been filled. Owing to this zone of weakness, it is possible to twist off the neck 21 of the capsule 17 as can be seen in FIG. 4. It is now possible to apply a pressing force as indicated by the arrows A, B to force the contents of the capsule, that is to say the stain removing agent 22' in paste form to a strip of textile material 23, for example.

In the embodiment shown, a cutting saw is provided which is in the form of saw teeth at the edge 24. This can be used to separate neck 21 from the capsule 17. The cardboard plate 12 creates an edge sufficiently rigid and sharp that saw toothed edge 24 will cut through weakened zone 22 of capsule 17. The saw teeth can be reinforced by extending the plastic layer and/or the foil layer to the saw teeth edge. Instead of this edge with saw teeth, it is also possible to provide a separate cutting device in the package. It is, however, preferred to provide the cutting device in the form of saw toothed edge 24 because the possibility of the cutting device being lost is eliminated.

As is known, stain removing agents in the form of paste must be removed after drying with the help of a brush or scraper. Since such a brush is not always available, for example on a journey, another edge of the receiving plate 12 is corrugated as is shown by reference numeral 25. Owing to this corrugated construction a structure is produced with which the dried residues of the stain removing agent paste can be brushed off without any difficulties. Naturally, the package can also be provided with a small handy brush, or by suitable cutting of one edge of the receiving plate 12 it is possible to provide a brush-like structure of a type other than the corrugated brush or scraper edge.

In the embodiment shown only one filled receiving plate 12 is accommodated in the box 1. It is, however, a matter of course that the apparatus in accordance with the invention can also be so constructed that by making the box 1 larger, several receiving plates or carrying plates filled with capsules 17 and 18, respectively, can be arranged one on top of the other.

The principle of the invention can also be seen to be useful for the reception or vending of liquid stain removing agents. From a cleaning standpoint, agents in paste form are preferred in that liquid stain removing agents do not generally ensure that after drying, no margin remains on the textile material or the like which is cleaned.

It is, of course, understood that the above is merely a preferred embodiment of the invention and that various changes and alterations can be made without departing from the spirit and broader aspects of the invention.

The embodiments of the invention in which an exclusive property or privilege is claimed are defined as follows:

1. An apparatus for packaging in portions a stain removing agent, said packaging apparatus comprising: capsules for containing stain removing agent; said capsules being made of a material which can be deformed by the action of pressure; a receiving plate including receiving troughs for individually receiving said capsules, said receiving plate including integral scraper means at one edge thereof for permitting scraping of an area after application of said stain removing agent, said integral scraping means comprising said plate including corrugations along an edge thereof to thereby define said scraper means; a covering sheet extending over said receiving plate and covering said capsules.

2. The apparatus in accordance with claim 1, in which said capsules having a bottle shape, including a body portion and a narrower neck portion projecting from said body portion.

3. The apparatus in accordance with claim 2, in which said neck of each of said capsules includes a zone of weakness adjacent said body of said capsule.

4. The apparatus in accordance with claim 3 in which said receiving plate includes at least on one edge defining cutting means for cutting each said capsule.

5. The apparatus of claim 4 in which said cutting means comprises saw teeth formed in said one edge of said receiving plate.

6. The apparatus in accordance with claim 5 in which said receiving plate includes at least one folding flap for advertising text and/or instructions for use.

7. The apparatus in accordance with claim 6 which further includes a box in which said receiving plate is accommodated.

8. The apparatus in accordance with claim 7 in which said box is provided with a suspension rail.

9. The apparatus in accordance with claim 2 in which said receiving plate includes at least on one edge defining cutting means for cutting each said capsule.

10. The apparatus of claim 9 in which said cutting means comprises saw teeth formed in said one edge of said receiving plate.

11. The apparatus in accordance with claim 1 in which said receiving plate includes at least on one edge defining cutting means for cutting each said capsule.

12. The apparatus of claim 1 in which said receiving troughs of said receiving plate are made of a material capable of being deformed under pressure and said covering sheet is of a thin material capable of being readily broken whereby a user can eject a capsule from said receiving plate by applying pressure to the rear of the trough thereby deforming said trough and forcing said capsule through said covering sheet.

13. The apparatus of claim 12 in which said covering sheet is a foil material and said troughs are thin plastic.

14. The apparatus of claim 13 in which said receiving plate comprises a cardboard layer having apertures therein, a plastic layer including deformations extending through said apertures to define said troughs and a foil layer on top of said plastic layer to define said covering sheet.

* * * * *